US008347536B2

(12) United States Patent
Sadowski

(10) Patent No.: US 8,347,536 B2
(45) Date of Patent: Jan. 8, 2013

(54) DISPLAY DEVICE

(76) Inventor: Paul Sadowski, Warren, MI (US)

( * ) Notice: Subject to any disclaimer, the term of this patent is extended or adjusted under 35 U.S.C. 154(b) by 148 days.

(21) Appl. No.: 12/322,182

(22) Filed: Jan. 30, 2009

(65) Prior Publication Data

US 2010/0192429 A1 Aug. 5, 2010

(51) Int. Cl.
*G09F 19/00* (2006.01)

(52) U.S. Cl. ..... 40/535; 40/376; 40/403

(58) Field of Classification Search ..... 40/530, 40/531, 535, 376, 398, 403, 904, 372; 281/27.3, 281/38, DIG. 1; 402/60
See application file for complete search history.

(56) References Cited

U.S. PATENT DOCUMENTS 557,788 A * 4/1896 Faifer ..... 402/63
1,805,268 A * 5/1931 Tresback ..... 281/27.3
3,325,934 A * 6/1967 Rhude ..... 40/530
3,972,632 A * 8/1976 Carter ..... 402/46
4,352,583 A * 10/1982 Errichiello ..... 402/75
5,709,409 A * 1/1998 Engel ..... 281/29

* cited by examiner

*Primary Examiner* — Gary Hoge
(74) *Attorney, Agent, or Firm* — The Weintraub Group, P.L.C.

(57) ABSTRACT

A display device includes a panel that is mountable to a vertical wall, and a leaf assembly comprised of a stack of like shaped leaves that are bundled together and connected to the panel, and a plurality of magnets that enable the leaves to be magnetically held in one or the other side of the panel but be manipulated by a user with one hand, in a flipping manner, thereby freeing the user's other hand to perform tasks related to use of the display device. The panel includes a slot through which rearward end portions of the leaves are passed and bundled by compression plates, thus leaving the connection arrangement hidden from view and aesthetically pleasing. In an arrangement, a frame is provided about the panel to guide and support, at least in part, the lower edges of the leaf assembly.

10 Claims, 4 Drawing Sheets

FIG 2
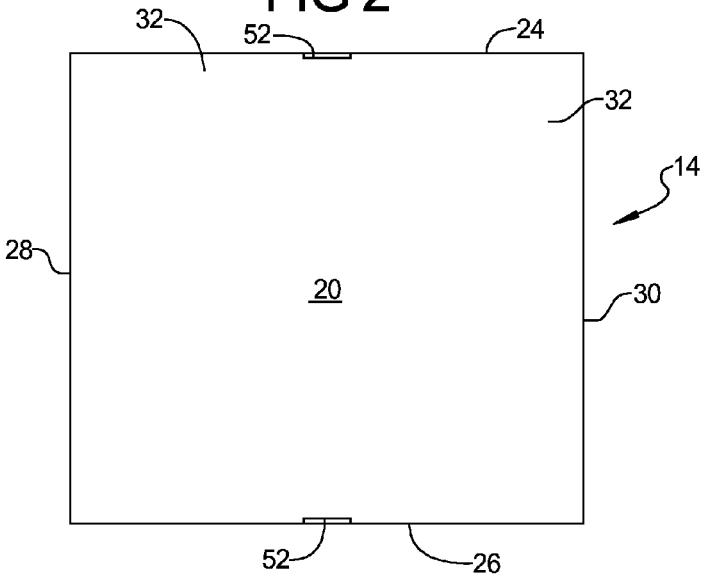
FIG 3
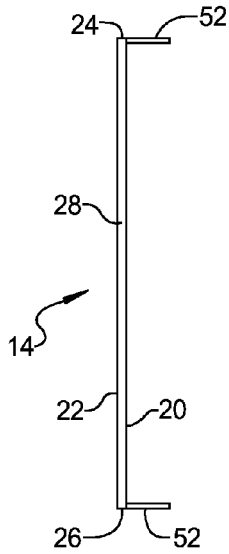
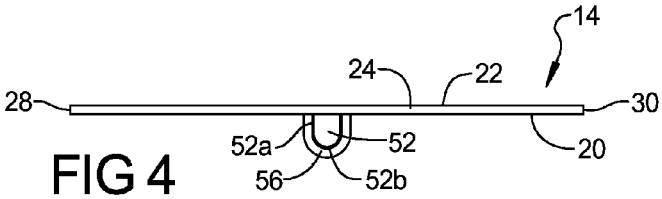
FIG 4
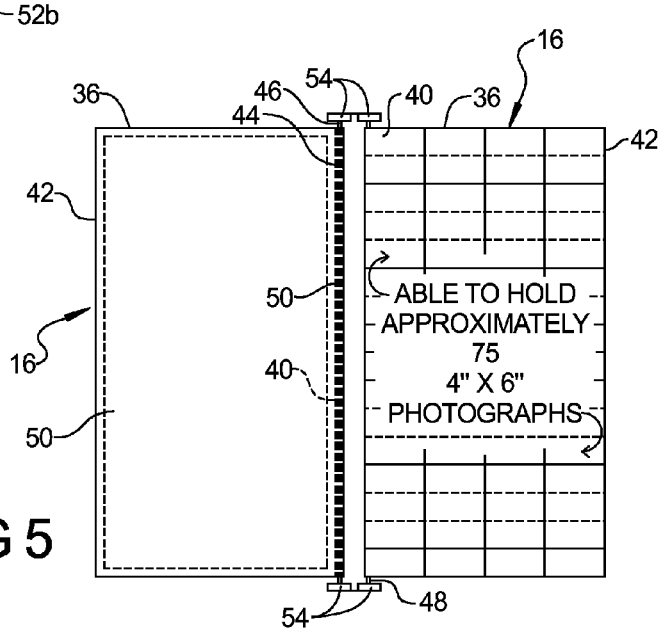
FIG 5

FIG 6
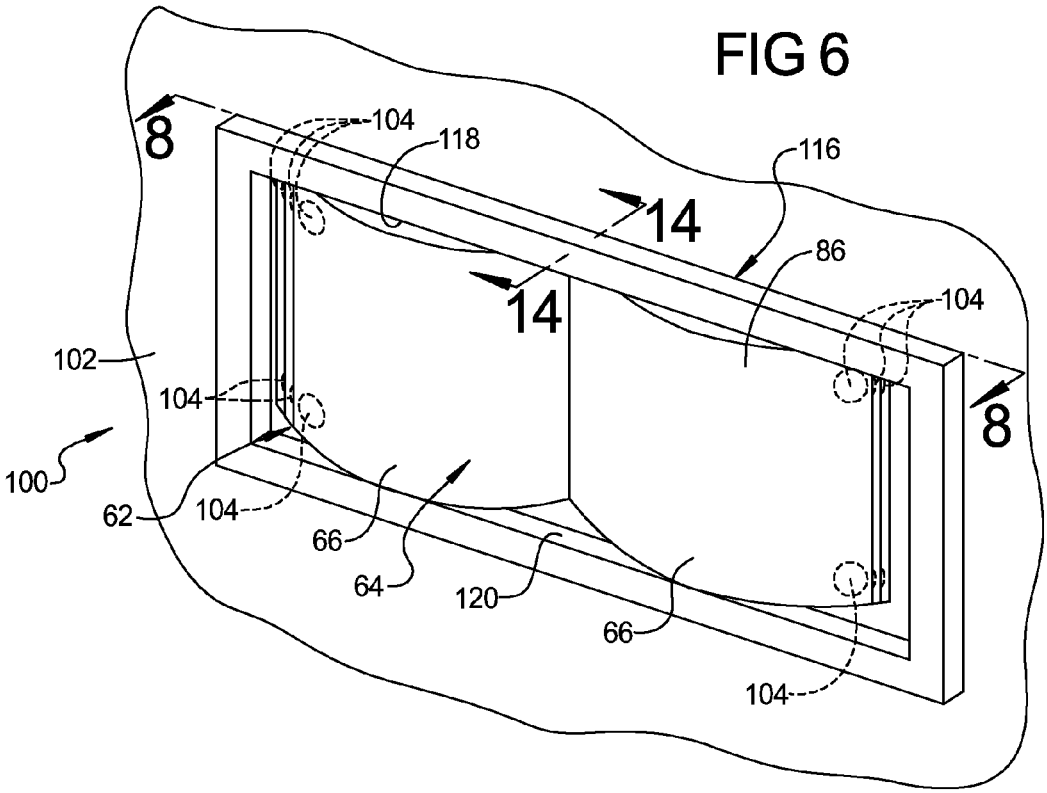
FIG 7
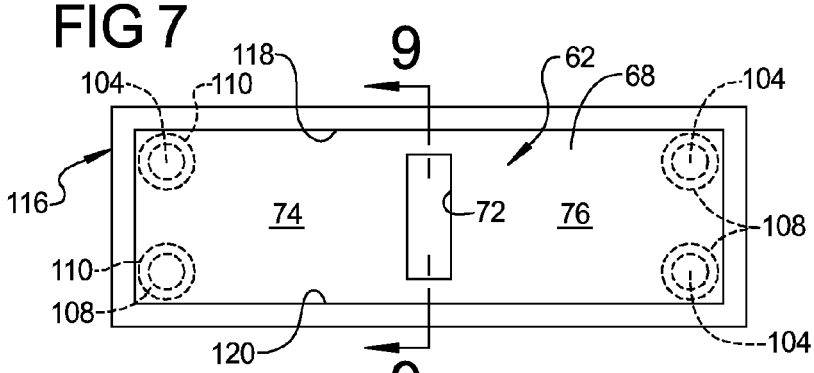
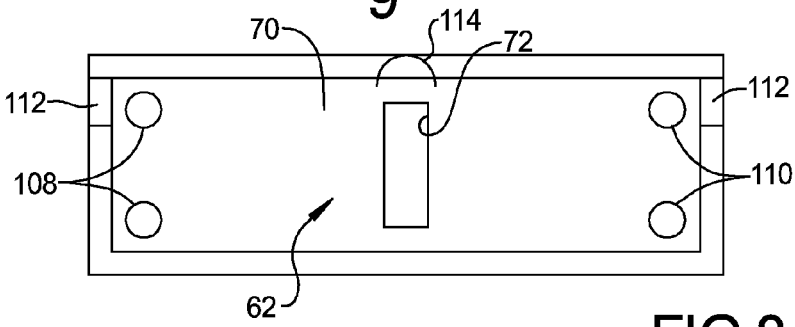
FIG 8

DISPLAY DEVICE

BACKGROUND OF THE INVENTION

1. Field of the Invention

The present invention pertains to display devices, and more particularly, to a wall-mounted notebook-like display device with movable display leaves which can be manipulated by a demonstrator and like personnel with one hand, freeing the user's other hand to perform tasks related to use of the display device.

2. Description of Related Art

Display devices are known and take many shapes and forms. In some applications, the display device is used to display photographs, new products, charts, and like information.

Oftentimes, individual sheets are secured along their top edges, and the sheets pulled upwardly and over the top, wherein new or previous sheets and data may be displayed. Such is useful but does not allow for rapid display of information, in that sheets previously folded up and over present a problem for the user. Manipulating the sheets is difficult and oftentimes requires both hands.

The ability to move forwardly or rearwardly, and having a hand free would be desirable.

Further, the display device may not enable the mounting, and rapid unmounting, of a large number of items, such as photographs, to be displayed.

Desirably, a device for mounting, displaying, and showing a large number of photographs would be desirable.

SUMMARY OF THE INVENTION

According to this invention, a display device comprises a planar generally rectangular rigid panel having a front surface, the rear surface of the panel being adapted to be mounted to a support wall, a plurality of planar generally rigid display leaves, means for mounting the leaves to the panel, said means for mounting enabling the display leaves to be moved from first and second positions and generally parallel relation with one another and the front surface, the movement being in a flipping motion and means for retaining the leaves in superposed generally parallel relation with one another and the front surface in each such position. The movement is in a "flipping motion" whereby the movement causes the surfaces of the leaf to be moved from exposed and hidden from view.

According to this embodiment, the mounting panel may comprise a pair of like shaped panels, the panels being generally rectangular, conjoined along a common edge, and the panel assembly mounted to the wall. Further, so mounted, the mounting panel(s) may be oriented such that the long dimension of the mounting panel extends horizontally, whereby the leaves are flipped laterally, about a vertical axis, and from one to the other side of the mounting panel front surface. Equally, the mounting panel(s) may be oriented such that the long dimension of the mounting panel extends vertically, whereby the leaves are flipped laterally up and down, about a horizontal axis, and from one to the other side of the mounting panel front surface.

The means for mounting the leaves to the panel comprises a pair of spaced apart support brackets, each support bracket having a U-shaped guide track therein, and a retention rods associated with an edge of the leaf, the retention rods being associated with like edges of the leaves. The retention rod is axially elongated, has opposite end portions received in the guide tracks of the support brackets, and a retention cap at each end whereby to retain the retention rod for sliding movement relative to the support brackets.

According to an aspect of this embodiment, the support brackets are affixed to the mounting panel(s) by studs in such a manner as to be perpendicular to and project upwardly and away from the front surface of the mounting panel(s). The U-shaped guide tracks are oriented such that each has opposite ends proximate to the front surface of the panels(s) and a medial portion spaced from the front surface.

Further and according to this embodiment, the means for retaining includes at least one magnet at each lateral side of the mounting panel and a corresponding magnet at the outer lateral edge of each said leaf, the outer lateral edge being distal to the retention rod. The leaf is flipped relative to the support brackets, whereupon the magnet in the leaf is disengaged from magnetic attraction with the magnet in one side of the mounting panel and into registration and magnetic attraction with the magnet in the other side of the mounting panel. The leaf, so moved, is substantially parallel to the front surface of the mounting panel and whatever leaves are positioned one or the other side of the mounting panel.

Where leaves may be positioned on one or the other side of the mounting panel, the flipping movement causes the magnet on the leaf being flipped to be moved from attraction with the magnet in a leaf on one side of the mounting panel and into registration and attraction with the magnet in a leaf on the other side of the mounting panel.

Depending on the application, the panel(s) and leaves are of a rigid material. In one preferred aspect, the leaves and mounting panel(s) are of a composite material sold under the trade name Masonite®. Alternatively and according to another preferred aspect, the leaves and the mounting panel (s) are molded of a high-density polymeric material. In some applications, the panel(s) and leaves may be comprised of one and the other of the composite Masonite® and molded of high density polymeric material.

Depending on the material selected, the method of retaining the leaves to the mounting panel(s) may be varied. For example, with the composite material, the retention rod may be disposed within a socket provided along the inward edge of the leaf. In the instance wherein the leaves or mounting panel(s) are of polymeric material, the retention rod may be molded into the material along an edge of the leaf and the mounting studs and magnets integrally molded into the polymeric material.

According to this application, there is disclosed a display device adapted to be mounted to a vertical support surface, comprising:

- a rigid support panel having front and rear surfaces and a slot extending through the panel, the slot dividing the panel and the front surface thereof into first and second sections,
- a leaf assembly removably mounted to said panel and, at least in part, disposed in said slot, said leaf assembly comprising a stack of compliant leaves having laterally spaced first and second edge portions, and means for binding the second edge portions together, wherein the bound second edge portions are juxtaposed with the rear surface and hidden from view from a viewer looking at the front surface, the leaf portions proximate to the bound second edge portions extend through said slot, and the first edge portions are disposed in overlying relation with and free to flip between the opposite sections of the front surface of the panel, and
- a plurality of permanent magnets, including a magnet incorporated into each first edge portion and a magnet incorporated into the first and second sections of said panel, the magnets being located in a manner that the magnets of the leaves and the panel register with one another when the leaves are overlying one or the other section of the front surface.

According to this display device, each leaf is formed by a pair of rectangular shaped sheets of transparent material that are conjoined to one another in a manner to form a pocket having an opening along one edge of the conjoined sheets for depositing a display item into the pocket, and the permanent magnet of said leaf is disposed in said pocket.

Preferably, the transparent sheets of each respective leaf are of a flexible polymer and the permanent magnet of respective leaf is disposed on a separate sheet of compliant material, the sheet of compliant material being complementary to and fitted into the pocket of said leaf.

Further, the display device comprises means for mounting the panel on the vertical support surface. In an aspect thereof, the mounting comprises first and second mounting members of magnetic material on the rear surface of the panel, the mounting members registered with respective of the permanent magnet of the first and second section and adapted to mount the panel on a magnetic structure.

Importantly, the magnetic members cooperate with the panel and the leaves in a manner that all of the leaves of the assembly may be magnetically held together atop one section or the assembly divided and the leaves of each divided portion magnetically held together and atop one and the other section.

In another aspect, the mounting is adapted to position the slot horizontally and first section vertically above the second section, and the magnets are of appropriate magnetic strength to retain and hold the weight of all or some of the leaves in the upper first section or permit some or all of the leaves to be flipped downwardly and magnetically retained in the lower second section.

Preferably, the means for binding comprises the second edge portions being provided with an opening, a pair of compression plates disposed on opposite respective sides of the second edge portions of the leaf assembly, and a nut and bolt assembly, the nut being associated with one compression plate and the bolt being associated with the other compression plate and extending through the openings of the leaves, threadable tightening engagement of the nut to the bolt compressing the plates against the leaves.

The present invention will be more clearly understood with reference to the accompanying drawings and to the following Detailed Description, in which like reference numerals refer to like parts and where:

BRIEF DESCRIPTION OF THE DRAWINGS

FIG. 2 is a plan view of a panel of the display device shown in FIG. 1;

FIG. 3 is a side view of the panel shown in FIG. 2;

FIG. 4 is a top view of the panel shown in FIG. 2;

FIG. 5 is a plan view of two leaves of the display device, in side-by-side relation;

FIG. 6 is a perspective view of a second embodiment of a wall mounted display device according to this invention;

FIG. 7 is a plan views of the front surface of a mounting panel;

FIG. 8 is a view taken along line 8-8 of FIG. 7 of the rear surface of the mounting panel;

DETAILED DESCRIPTION OF THE PREFERRED EMBODIMENT

Figure 1:
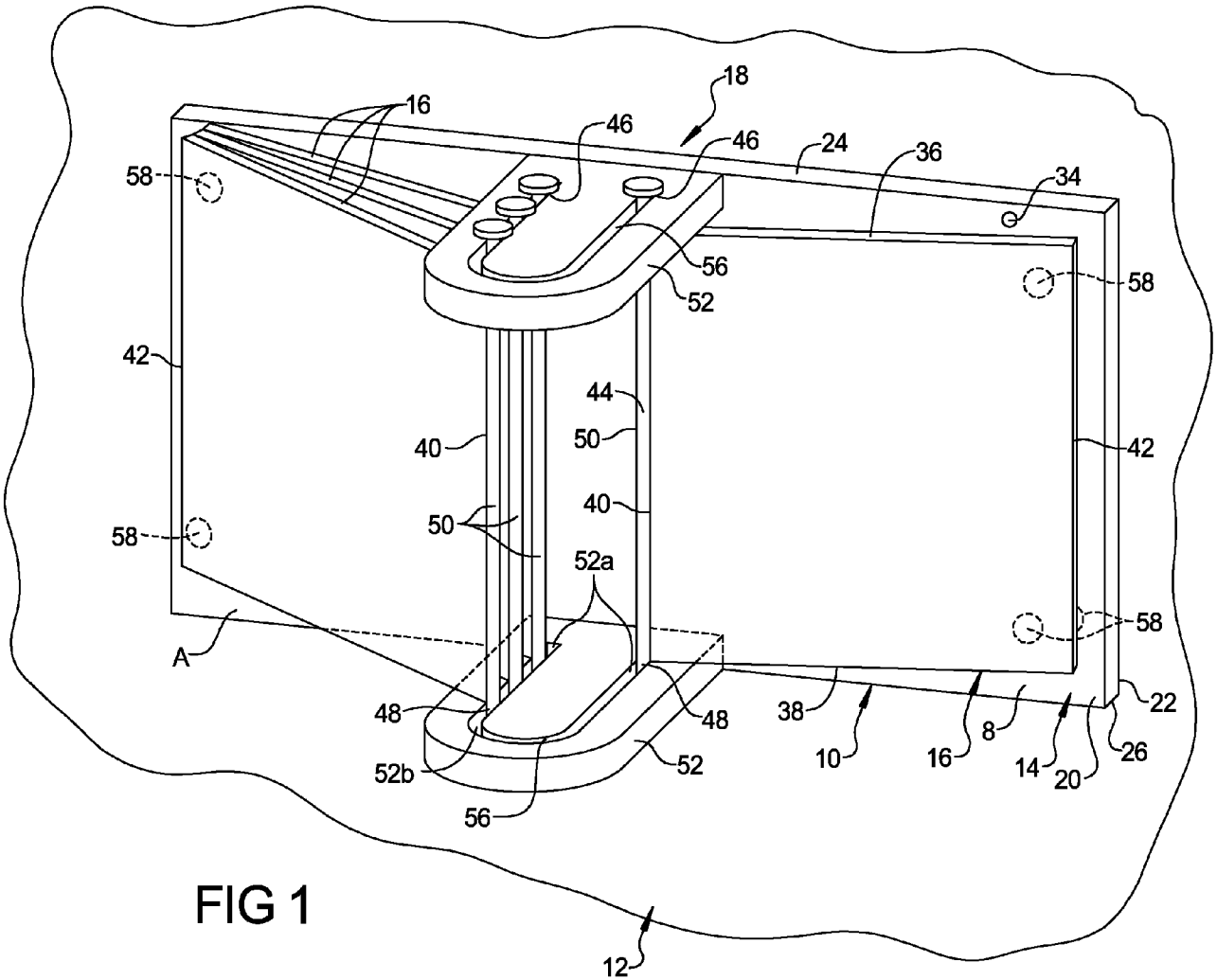
FIG. 1 is a perspective view of a wall mounted picture frame or display device according to the present invention.
Figure 9:
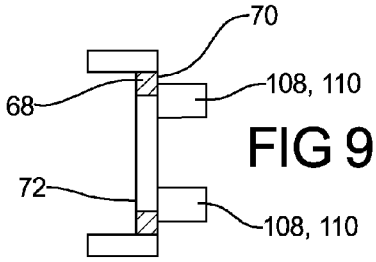
FIG. 9 is a section view taken along line 9-9 of FIG. 7.
Figures 10, 11, 12, 13:
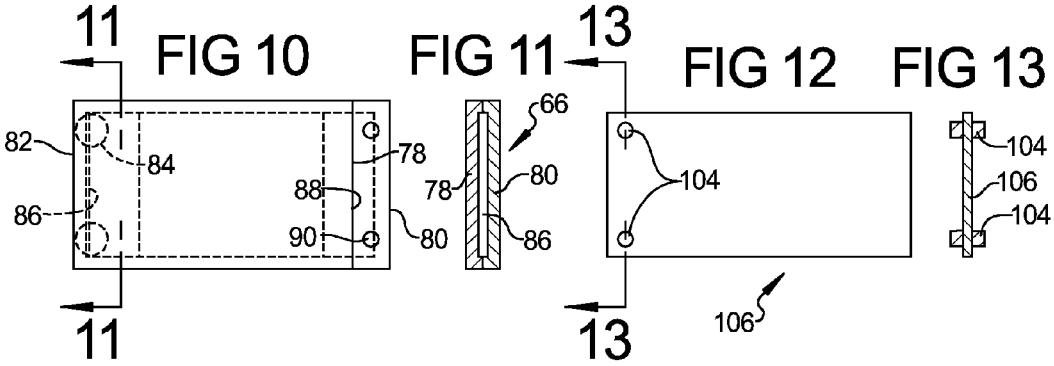
FIG. 10 is a plan view of one side of a display leaf.
FIG. 11 is a section view taken along line 11-11 of FIG. 10.
FIG. 12 is a plane view of a compliant sheet adapted to be received in a pocket formed in the leaf of FIG. 11.
FIG. 13 is a section view taken along line 13-13 of FIG. 12.
Figure 14:
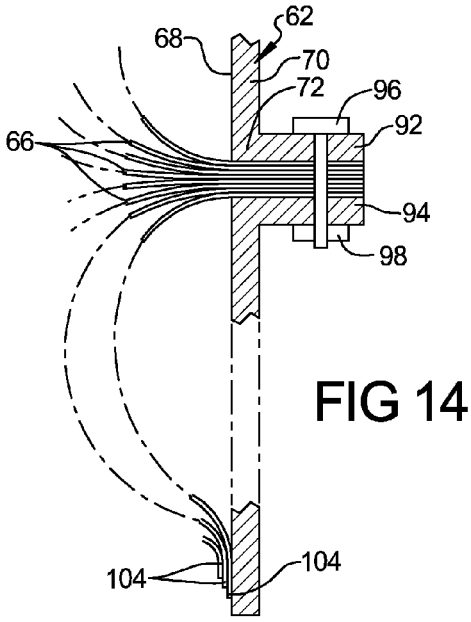
FIG. 14 is a view taken along line 14-14 of FIG. 1 illustrating the binding together of leaves in a central slot of the panel and the compression plates and nut and bolt assemblies to compress the end portions of the leaves together.

Referring first to FIG. 1, a notebook-like display device 10 of the present invention is shown in use. The display device 10 is mounted to a wall 12 and is adapted to be manipulated by a demonstrator and like personnel with one hand, freeing the user's other hand to perform tasks related to use of the display.

The display device 10 comprises a rigid, generally flat (or planar) rectangular shaped mounting panel 14, a plurality of rigid, generally flat (or planar) leaves 16, and a combined mounting and retaining mechanism 18 for mounting the leaves for flipped movement between first and second positions "A" and "B" on the panel 14. The mounting panel 14 includes opposed generally planar front and rear surfaces 20 and 22 and is mounted to the wall 12 in a manner that the rear surface 22 is juxtaposed against the wall and the front surface 20 faces outwardly. The flipping movement of the leaf reverses the relationship of the leaf relative to the front surface 20 of the panel and causes the surface of the leaf initially facing outwardly and away from one half of the front surface 20 to be facing inwardly and towards the other half of the front surface 20.

Further, referring also to FIGS. 2-4, the mounting panel 14 includes upper and lower edges 24 and 26, opposite lateral edges 28 and 30, and countersunk apertures 32. The mounting panel 14 is mounted to the wall 12 by fasteners 34 being received in the apertures 32 and attached to the wall therebehind. So mounted, the upper and lower edges 24 and 26, which define the long dimension of the panel, are disposed horizontally, and the lateral edges 28 and 30, which define the short dimension of the panel 14, are disposed vertically.

As shown, the mounting panel 14 is one-piece, generally rectangular, the long dimension is arranged horizontally, and the leaves 16 are adapted to be flipped from left to right about an axis disposed vertically. For some applications, and for shipping considerations, the mounting panel 14 may be in two pieces and the two pieces, or panels, conjoined along a common edge.

Further, while the mounting panel 14 is shown oriented horizontally, the long dimension of the rectangular shaped panel may be arranged to extend vertically, with the leaves 16 being adapted to be flipped vertically up and down about an axis disposed horizontally.

Referring to FIGS. 1 and 5, the leaves 16 are generally rectangular and each includes upper and lower edges 36 and 38, and inner and outer edges 40 and 42. The leaf 16 is generally flat, planar, and includes first and second display surfaces or faces. When mounted, the surfaces of the leaves are generally parallel to the front surface of the mounting panel or the other leaves. When flipped, one and the other surface of the leaf is moved from a position where the surface faces outwardly (i.e., is exposed) or faces inwardly (i.e., is hidden from view).

Preferably, the panel 14 and the leaves 16 are integrally molded from a high-density polymer. The thickness and shape of the leaf is configured such that each leaf is generally rigid. As will be described herein below, the polymeric material is such as to enable retention rods, magnets, and mounting studs to be integrally molded therewith and be accurately positioned.

In some applications, the mounting panel(s) 14 and leaves 16 are of a fiberboard, particle board, or like hard and rigid sheet of material used in paneling, or partitions, and rigid plastic such as an acrylic, polycarbonate, etc. One suitable material is sold under the name Masonite®.

Likewise, the mounting panel(s) may comprise glass or metal sheets.

The combined mounting and retaining mechanism 18 comprises an axially elongated retention rod 44, one retention rod for each leaf 16 and each rod having opposite end portions 46 and 48, a retention sleeve or socket 50 for mounting a retention rod to the inner edge 40 of the leaf, and a pair of U-shaped brackets 52 for mounting and retaining the leaves 16 to the panel 14. The retention rod 44 is axially elongated and the upper and lower end portions 46 and 48 thereof terminate in an end cap 54, shown as having a T-shape.

The mounting or support brackets 52 are spaced apart, attached to the upper and lower edges 24 and 26 of the mounting panel 14, and project perpendicularly upwardly and outwardly from the front surface 20 of the panel. In the embodiment shown, threaded fasteners (not shown) are used to attach each support bracket 52 to the panel. The fasteners enter the panel from the rear surface 22 and extend into the support brackets 52. In some applications, depending on the material selected, the support brackets may be affixed to the panel by mounting studs. Desirably, in the situation wherein the panel is of high-density polymer, the studs may be embedded into place within the polymer.

In the situation wherein the mounting panel 14 comprises a single panel, or a pair of conjoined panels, and the mounting panel(s) and leaves are of polymeric material, each of the leaves are connected to the panel(s) by a retention rod. The retention rod is integrally molded into and extends along one edge of the leaf into which molded.

Each support bracket 52 includes a U-shaped slot or guide track 56, and each guide track has opposite ends 52*a* thereof proximate to the surface 20 and a medial portion 52*b* spaced outwardly from a centerline extending vertically between the upper and lower edges of the panel 14. The guide tracks 56 of the upper and lower brackets 52, respectively, are aligned with one another and receive the upper and lower end portions 46 and 48 of the retention rods 44. The end caps 54 are disposed above and below the upper and lower brackets 52 and act to retain and captivate each assembly of a leaf 16 and retention rod 44 within the guide tracks 56 and constrain the leaf 16 for sliding movement within the guide tracks 56.

The end portions 46 and 48 of the retention rod 44 are adapted to slide (or glide) relative to the slots or guide tracks 56, and enable the leaves 16 to move from the first position "A", juxtaposed in generally parallel relation with one half of the panel upper surface 20, and to the second position "B", juxtaposed in generally parallel relation with the other half of the panel upper surface 20.

According to an important aspect of this invention, the mounting panel(s) 14 and leaves 16 are provided with complementary magnetic elements to captivate or otherwise retain the leaves in the first and second positions. According to a preferred embodiment, a cylindrical permanent magnet 58 is provided in the upper and lower outer corners of each leaf 16, and a corresponding permanent magnet 58 is provided in the upper and lower outer corners of the mounting panel 14. As noted, if the mounting panel and leaves are molded of polymeric material, the magnets may be integrally molded within the body of the polymer.

In one position, all of the leaves 16 may be juxtaposed with one or the other side of the front surface 20 of the panel 14. In another position, some of the leaves may be juxtaposed with one side of the panel and other of the leaves may be juxtaposed with the other side of the panel 14. In either arrangement, the magnets on the leaves 16 are registered with a corresponding pair of the magnets 58 on the panel 14 or on a leaf therebelow and upon which flipped, the magnets attracting each other and operating to prevent unwanted swinging movement of a leaf, or leaves, from one position to another, or away from retained relation with the panel 14.

Alternatively, a magnetic strip 60 (see FIG. 5) may extend around the perimeter of each leaf and the lateral ends of the panel.

It should be stated that, although not shown, alternative means for retaining the leaves in position may be used in lieu of the magnet, such as a clasp, retainer clip, or similar design. Further, interfitting protuberances and recesses operating between the leaves and panel(s) and which frictionally releasably engage with one another are contemplated herein.

In a preferred embodiment, the display device 10 is characterized as a wall mounted picture frame, with the leafs 16 being adapted to hold multiple sized pictures on numerous of the leafs 16. The display device 10 provides a picture display that doubles as a wall covering.

In some applications, a binder (not shown) may be used to mount picture frames to the wall mount display device 10.

In one embodiment, the panel 14 is about 5 feet 4 inches wide, 5 feet high, and the leaves 16 are able to hold approximately 75 photographs that measure 4 inch by 4 inch.

In another embodiment, the panel 14 is 31 inches wide by 15½ inches high and can hold up to ten (10) 4×6 inch photos.

The user may with ease move the leaves, as desired, to display photographs and other materials mounted on the leaves. In the situation wherein advertising or other material is to be presented to a business meeting, with one hand the displayer may move the leaves, leaving the other hand free for other use, such as using a pointer.

In a second preferred embodiment and as shown in FIGS. 11-14 according to this invention there is provided a display device 100 adapted to be supported on a vertical support surface 102. The display device 100 comprises a rigid support panel 62 and a leaf assembly 64 removably mounted to the support panel. The leaf assembly 64 comprises a stack of like compliant leaves 66 and an arrangement for binding the leaves 66 together.

The support panel 62 is generally rectangular in shape, rigid, has planar front and rear surfaces 68 and 70 and a rectangular shaped slot 72 extending through the panel and between the surfaces. The slot 72 divides the panel and the front surface thereof into first and second sections 74 and 76.

The leaf assembly 64, at least in part, is disposed in the slot 72, extends through the slot, and the leaves 66 thereof overlie the front surface 68 of the support panel 62. Preferably, each leaf 66 is generally rectangular in shape and is formed by a pair of rectangular shaped sheets 78 and 80 of transparent material being conjoined to one another in a manner to form laterally spaced first and second edge portions 82 and 84 and a pocket 86 having an opening 88 proximate to the second edge portion 84 of the conjoined sheets for depositing a display item into the pocket.

The binding arrangement is disposed entirely at the rear surface 70 of the panel 62 and comprises the second edge portions 84 being provided with at least one and preferably multiple openings or holes 90, a pair of compression plates 92 and 94, and nut and bolt assemblies for each leaf hole 90. The compression plates 92 and 94 are generally coextensive with second edge portions 84 and are disposed on opposite respective sides of the leaf assembly (i.e., against the top and bottom second edge portions of the leaves of the stack of leaves) when the second edge portions of the leaves are stacked together in bundled relation.

In the nut and bolt assembly, a threaded bolt 96 is associated with one compression plate 92 and the threaded stem thereof extends through the aligned leaf openings 90 to threadably engage with a corresponding nut 98 associated with the other compression plate 94. Threadable tightening engagement of the nut(s) to the bolt(s) acts to compress the second edge portions 84 together into a compact bundle.

In the leaf assembly 64, the bound second edge portions 84 are juxtaposed with the rear surface 70 and hidden from view from a viewer looking at the front surface 68, the leaf portions proximate to the bound second edge portions 84 extend through the slot 72, and the first edge portions 82 are disposed in overlying relation with and free to flip between the opposite sections 74 and 76 of the front surface 68 of the panel 62.

Importantly, a plurality of permanent magnets 104 is provided. At least one, and preferably two, magnets are incorporated into the first edge portion 82 of each of the leaves 66, and corresponding magnets 104 are incorporated into each of the first and second sections 74 and 76 of the panel 62. The magnets 104 are located in a manner that the magnets of the leaves 66 and the panel 62 register with one another when the leaves are flipped from side to side and to be in overlying relation with one or the other section of the front surface.

In a preferred embodiment, the material of the leaves 66 is a flexible polymer, a sheet 106 of compliant material and of complementary shape to the leaf is inserted into the pocket 86, and the permanent magnet(s) 104 is disposed on the compliant sheet proximate to first edge portion and disposed inside the pocket, preferably hidden from view in the assembly.

In some arrangements the leaf 66 is formed of compliant material and the magnet(s) 104 incorporated into the leaf, such as by lamination.

The display device 100 further includes an arrangement for mounting the panel onto the vertical support surface. Different types of support surfaces are contemplated, including wall board, and metal panels such as found on industrial shelving and filing cabinets.

In one arrangement for mounting, a first and a second mounting member 108 and 110 are disposed on the rear surface 70 of the panel 62. The mounting members 108 and 110 are each comprised of a magnetic material and disposed in registry with the permanent magnet 104 of each section for retaining the leaves. Desirably, the magnetic strength of the mounting members 108 and 110 enable the panel 62 and leaf assembly 64 to be mounted atop a magnetic structure, such as a metal filing cabinet.

The magnetic mounting members 108 and 110 cooperate with the panel 62 and the leaves 66 in a manner that all of the leaves of the leaf assembly may be magnetically held together atop one section of the assembly or divided and the leaves of each divided portion magnetically held together and atop one and the other section.

The magnetic mounting members 108 and 110 have sufficient magnetic strength to position the slot 72 horizontally and the first section 74 vertically above the second section 76, and retain and hold all or some of the leaves 66 in the upper first section 74 or permit some or all of the leaves to be flipped downwardly and magnetically retained in the lower second section.

The arrangement for mounting may also include adhesive strips 112 or mounting hooks 114. In this regard, various forms of adhesive strips from 3M, marketed as Poster Strip with Command™ Adhesive are desirable for securing objects firmly to a wall, without sagging or falling down, because the strips of Command™ adhesive generally permit removal without surface damage.

Depending on the application, the display device may include a frame 116, which extends around and projects upwardly from the front surface 68. The upward projection of the frame forms upper and lower walls 118 and 120, with the lower wall 120 being dimensioned to project away from the surface 68 by an amount sufficient to provide support to at least a portion of the leaves 66 when magnetically attracted and held to one and the other section of the front surface.

The invention having been thus described, it will be obvious that the same may be varied in many ways. Such variations are not to be regarded as a departure from the spirit and scope of the invention, and all such modifications as would be obvious to one skilled in the art are intended to be included within the scope of the following claims.

What I claim is:

1. A display device adapted to be supported on a vertical support surface, comprising:

a rigid support panel having front and rear surfaces and a slot extending through the panel, the slot dividing the panel and the front surface thereof into first and second sections, a leaf assembly removably mounted to said panel and, at least in part, disposed in said slot, said leaf assembly comprising a stack of compliant leaves having laterally spaced first and second edge portions, and means for binding the second edge portions together, wherein the bound second edge portions are juxtaposed with the rear surface and hidden from view from a viewer looking at the front surface, the leaf portions proximate to the bound second edge portions extend through said slot, and the first edge portions are disposed in overlying relation with and free to flip between the opposite sections of the front surface of the panel, and a plurality of permanent magnets, including a magnet incorporated into each first edge portion and a magnet incorporated into the first and second sections of said panel, the magnets being located in a manner that the magnets of the leaves and the panel register with one another when the leaves are overlying one or the other section of the front surface, wherein each said leaf is formed by a pair of rectangular shaped sheets of transparent material that are conjoined to one another in a manner to form a pocket having an opening along one edge of the conjoined sheets for depositing a display item into the pocket, and the permanent magnet of said leaf is disposed in said pocket.

2. The display device according to claim 1, wherein the transparent sheets of each respective leaf are of a flexible polymer and the permanent magnet of said leaf is disposed on a separate sheet of compliant material, the sheet of compliant material being complementary to and fitted into the pocket of said leaf.

3. The display device according to claim 2, wherein said means for mounting is selected form a group consisting of an adhesive strip, a mounting hook, and permanent magnet.

4. The display device according to claim 1, further comprising means for mounting the panel on the support surface.

5. The display device according to claim 4, wherein said means for mounting comprises a first and a second mounting member disposed on the rear surface of the panel, the mounting members each comprised of a magnetic material and disposed in registry with the permanent magnet of each respective first and second section, the mounting members being adapted to mount the panel on a magnetic structure.

6. The display device of claim 5, wherein the magnetic members cooperate with the panel and the leaves in a manner that all of the leaves of the assembly may be magnetically held together atop one section or the assembly divided and the leaves of each divided portion magnetically held together and atop one and the other section.

7. The display device of claim 4, wherein the means for mounting is adapted to position the slot horizontally and first section vertically above the second section, and the permanent magnets are of appropriate magnetic strength to retain and hold the weight of all or some of the leaves in the upper first section or permit some or all of the leaves to be flipped downwardly and magnetically retained in the lower second section.

8. The display device according to claim 1, wherein said means for binding comprises the second edge portions being provided with an opening, a pair of compression plates disposed on opposite respective sides of the second edge portions of the leaf assembly, and a nut and bolt assembly, the nut being associated with one compression plate and the bolt being associated with the other compression plate and extending through the openings of the leaves, threadable tightening engagement of the nut to the bolt compressing the plates against the leaves.

9. The display device according to claim 1, further comprising a frame, the frame extending around and projecting upwardly from the front surface to form first upper and lower walls, the lower wall being dimensioned to project upwardly by an amount to provide support to at least a portion of the leaves when magnetically attracted and held to one and the other section of the front surface.

10. The display device as claimed in claim 1, wherein the opening to the pocket is proximate to the second edge portion of the leaf bundle.

* * * * *